United States Patent [19]

Angioletti

[11] 4,258,946

[45] Mar. 31, 1981

[54] LOCK FOR WINDOW SASHES AND THE LIKE

[75] Inventor: Attilio Angioletti, Milan, Italy

[73] Assignee: Industrie Pirelli S.p.A., Milan, Italy

[21] Appl. No.: 955,308

[22] Filed: Oct. 27, 1978

[30] Foreign Application Priority Data

Dec. 1, 1977 [IT] Italy ..... 30224 A/77

[51] Int. Cl.[3] ..... E05C 17/56

[52] U.S. Cl. ..... 292/144

[58] Field of Search ..... 292/144, 201, DIG. 25

[56] References Cited

U.S. PATENT DOCUMENTS

| | | | |
|---|---|---|---|
| 2,310,887 | 2/1943 | Anderson | 292/144 X |
| 3,199,153 | 8/1965 | Weinstein | 292/201 X |
| 3,330,585 | 7/1967 | Pollin | 292/DIG. 15 |
| 3,400,767 | 9/1968 | Hermiz | 292/144 X |
| 3,624,761 | 11/1971 | Kohn | 292/144 |
| 3,926,460 | 12/1975 | Peterson | 292/144 |
| 4,021,066 | 5/1977 | McShane | 292/144 |
| 4,022,509 | 5/1977 | Bopp et al. | 292/144 X |

FOREIGN PATENT DOCUMENTS

| | | | |
|---|---|---|---|
| 600852 | 6/1960 | Canada | 292/144 |
| 994594 | 6/1965 | United Kingdom | 292/DIG. 46 |
| 1445030 | 8/1976 | United Kingdom | 292/144 |

*Primary Examiner*—Richard E. Moore

*Attorney, Agent, or Firm*—Stevens, Davis, Miller & Mosher

[57] ABSTRACT

A lock for a casement window sash, door or the like has a pneumatically actuated bolt which holds the sash in its closed position. The locking device has a chamber enclosed by a fluid impervious housing supported below the bottom of the sash. A slidable piston is disposed in the chamber with a rod projecting upwardly therefrom and against the sash when it is closed. A spring biases the piston upwardly to dispose the rod against the sash. A squeeze bulb for charging air under pressure into the chamber above the piston to move it in opposition to the spring is provided in an accessible location external of the chamber and is squeezed when it is desired to move the rod from against the sash so the sash can be swung into an open position.

10 Claims, 2 Drawing Figures

LOCK FOR WINDOW SASHES AND THE LIKE

Figure 1:
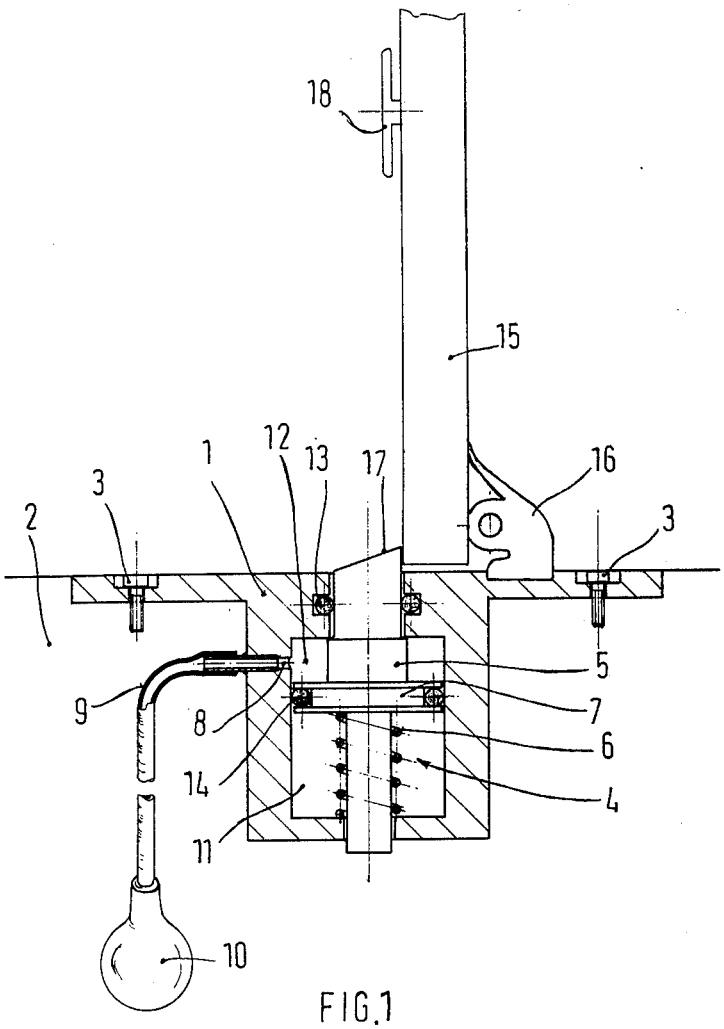

This invention relates to a device for locking a hinged sash of a window, door or other closure for an opening which is hung in the opening with hinges on one side thereof.

While the invention is described herein for convenience with reference to a window sash, the invention contemplates broadly any type of hinged member disposed in an opening for closing and opening it such as a casement window, door, shutter or the like.

It is moreover to be understood that the expression "locking of a window sash or the like" means maintaining the sash or the like in a position in which it completely closes the corresponding opening.

Therefore, the present invention relates more particularly to a device which confers to the lock of the window sash or the like special characteristics such as permanent improved air tightness and mechanical stability.

With reference to a casement window which represents the most general case and that where the device according to the present invention finds a particularly advantageous application, it is known that the lock of the window sashes (usually two in number) is normally a rigid rod mechanism arranged on one of the two sashes along the side opposite to the swinging sash.

In practice, two rigid and independent rods are positioned in appropriate guides provided on the edge of the sash or on the frame around a glass pane. The rods slide in a vertical direction by the action of a mechanical drive, generically constituted by a pivot or a gear wheel which engages with the rods, the drive being fast with an external handle.

The rotation of the handle, or any other suitable movement of the same, causes the simultaneous motion, in opposite directions, of the two rigid rods, originating the contemporaneous engagement or disengagement of their ends with respect to opposite casings provided in the upper and lower sides of the window frame, thereby locking the sash or allowing its rotation about its own pintle.

By disposing vertical edges of two window sashes alongside each other, one sash can be locked and the second sash fastened thereto thus eliminating the need for two locking devices.

The heretofore known locking devices such as the one described above have several disadvantages.

A first disadvantage is that after a period of time, the air-tightness and mechanical stability of the window deteriorate. The repeated actuation of the locking drives causes in fact a progressively enlarging clearance between the ends of the rigid rods and the walls of the casing into which the ends are inserted and a gradually increasing play between the two sashes and between their edges and those of the fixed frame on which they are hung.

This results in air infiltrations (with a consequent reduction of the thermal insulation) and the risk of deformations of breakage of the window panes due to impacts or vibrations. Therefore, the locking devices must be repaired or replaced frequently.

A further disadvantage is noticed when the sashes are of rather large dimensions. In fact, in that case, the rigid rods are more liable to deformation, and consequently must be stronger. This requires a group of drives and controls which are unavoidably heavy, technically complicated and require expensive installation.

A third drawback is that often a locking device is required on both sashes of a double sashed casement type window or on double doors having their unhinged edges facing each other.

All of the above indicated disadvantages are overcome by the device provided by the present invention.

It is therefore an object of this invention to provide an improved locking device for a window, door or the like hung with hinges in an opening in a wall or the like. Another object of the invention is to provide a locking device for casement windows, doors, window shutters and the like which is devoid of the foregoing disadvantages.

Figure 2:
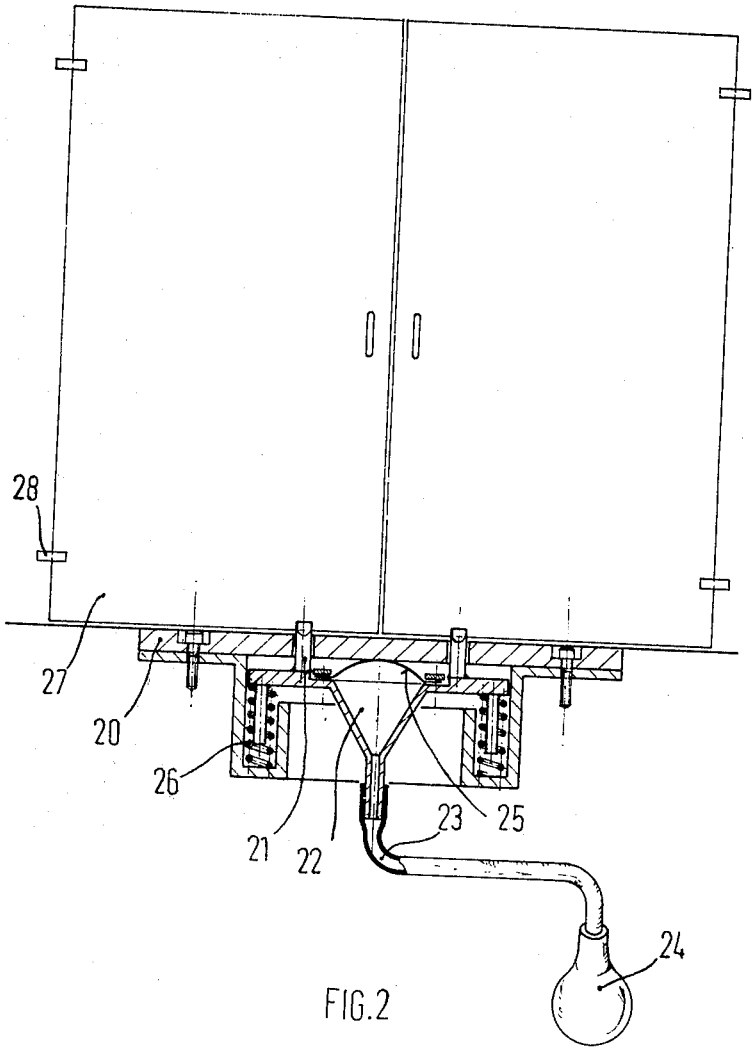

Other objects will become apparent from the following description with reference to the accompanying drawing wherein FIG. 1 is a cross-section of one embodiment of the invention; and FIG. 2 is a front elevation, partially in section, of a second embodiment of the invention.

The foregoing objects of the invention are accomplished by providing a device for locking hinged window sashes, doors or the like characterized in that it comprises a casing provided with at least one opening, at least one slidable stop member partially protruding from and totally returning into said casing through said opening, and means able to move said slidable stop member in opposition to resilient biasing means.

With reference to FIG. 1, the illustrated embodiment of the invention has a casing 1, disposed completely within base member or window jamb 2 of the fixed frame of the window and secured to jamb 2 by means of screws 3. The casing or housing 1 encloses a cavity 4 containing a slidable stop member 5 with an upright member having an inclined top surface 17. The upright member projects upwardly above space 4. The member 5 is moreover provided with a disc member 7 which divides the cavity 4 into a first and a second chamber of variable volume, 11 and 12, separated in a fluid-tight manner by a first flexible elastomeric ring 14 positioned between the upper and lower surfaces of the member 7. When it is not stressed, member 5 protrudes partially from the casing 1 in such a way that the lower corner of its inclined surface 17 is at the level of the plane of the jamb 2 (or does not protrude from said plane); this takes place owing to the biasing action of a spring 6 arranged in the variable volume chamber 11 of the cavity 4 between the lower surface of member 7 of member 5 and the wall of the cavity 4 opposite to said surface.

Moreover, in its variable volume chamber 12, the casing 1 has a lateral opening 8 in which is inserted, in a fluid-tight manner, one end of the small hose 9 (made of rubber or of other material), the other end of which is tightly inserted in the mouth of an elastic squeeze bulb 10.

The variable volume chamber 12, the lateral opening 8, the small hose 9 and the elastic bulb 10 contain gas (commonly air). The seal of the variable volume chamber 12 is insured in its upper part by a second elastic ring 13 into which slides member 5, permanently situated in a recess of the inner wall of the casing 1.

In the arrangement shown in FIG. 1, the window sash 15 is locked between a wall of member 5, perpendicular to the plane of the base member 2, and the gasket 16.

The height of the wall of member 5 protruding perpendicularly from the plane of the base member 2, the distance of said wall from the gasket 16, the material and the shape of gasket 16 are such as to ensure the locking of the sash 15 and good sealing characteristics against the passage of air together with a high mechanical stability.

To release the sash 15 from its locked position and to allow its rotation about its own pintles (not represented), it is sufficient to exert a slight pressure on the walls of the elastic bulb 10; this causes an increase in the pressure of the gas contained in the variable volume chamber 12 and consequently a motion of member 5 towards the inside of the casing, opposite to the thrust exerted by the spring 6. The insertion of member 5 in the casing must be such that the upper corner of its inclined surface 17 reaches at least the level of the plane of the base member 2.

With member 5 situated in this position (which remains unaffected as long as the elastic bulb 10 is pressed) the sash 15 can be freely rotated about its own pintles, if desired with the aid of the handle 18. Obviously, when the elastic bulb 10 is released, the initial pressure conditions are restored in the variable volume chamber 12, and member 5, under the thrust of the spring 6, projects again from the plane of the base member 2.

To bring again the sash 15 in the position represented in FIG. 1 (namely to carry out the locking of the sash), it is sufficient to push the sash against the inclined surface 17, without exerting any pressure on the elastic bulb 10. In fact, the sash 15 runs, with its lower edge, on the inclined surface 17, compelling 5 to return gradually inside the casing 1, against the action of the spring 6, until the upper corner of the inclined plane 17 reaches the level of the plane of the base member 2.

When the sash 15 has completely passed beyond the inclined surface 17, member 5 returns again to the position represented in FIG. 1. The locking of the sash 15 is therefore automatic.

With reference to FIG. 2, it can be noted that in this alternative embodiment the device comprises a casing 20 into which is arranged a pair of slidable blocking members 21 which, through suitable openings provided in the casing, may partially emerge from, and completely return in, said casing. The movement of members 21 is obtained by means of a liquid which fills the variable volume chamber 22, limited by a deformable and impermeable membrane 25 connected to members 21, a small hose 23 and an elastic bulb 24.

The increase of pressure of the fluid which takes place in chamber 22 owing to the compression of the elastic bulb produces at first the expansion of the membrane 25 against the inner walls of the casing 20 and then the return, by reaction, of members 21 into the casing 20, overcoming the action of the pair of springs 26.

Therefore, the hinged members 27 can rotate freely about their own pintles 28. As also in this case the ends of members 21 emerging from the casing 20 are shaped as inclined planes, the automatic locking operation is quite similar to that described in respect of the above indicated case.

In the described examples, the device according to the present invention is applied to the lower sill of the window and in a single unit.

It is evident that, in other cases, it may be convenient to apply several devices both in the lower frame member and in the upper frame member, causing the small hose to join in a single bulb, so that said devices can be actuated simultaneously by means of one drive only, In other cases, it is possible to arrange one or more devices on the same sashes maintaining, however, all the above described advantages.

Although only two embodiments of the present invention have been described, together with their operation, it is to be understood that the invention includes any other modification accessible to a technician of this field.

What is claimed is:

1. A device for locking a hinged closure member in a first opening characterized in that said device comprises a casing provided with a second opening, a slidable base member having a pin fixed thereto and disposed through the opening, resilient biasing means urging said slidable base memeber and pin to a postion where the pin protrudes through the second opening and locks the closure member in a closed position, and means for moving said slidable base member and pin in opposition to said resilient biasing means comprising a flexible bulb adapted to be squeezed to force air into the cavity.

2. A device of claim 1 characterized in that the end of said pin fixed to the slidable member which protrudes from the opening of said casing has a tapered surface.

3. The device of claim 1 characterized in that said means for moving said slidable member comprise at least one variable volume and fluid-tight chamber, opposing resilient means and a fluid contained in said chamber, a mobile portion of said chamber being connected to said slidable member and the volume variations of said chamber being caused, in opposition to said resilient means, by pressure variations of the fluid contained in said chamber.

4. The device of claim 3 characterized in that said means for moving said slidable member comprise a variable volume and fluid-tight chamber, a resilient spring and a gas contained in said chamber, said chamber being limited by the inner walls of the casing, by a first elastic sealing ring, into which slides the slidable member, connected to the inner walls of the casing and by a second elastic sealing ring fast with the mobile sidable and slidable along the inner walls of the casing, and the volume variations of said chamber being caused in opposition to said spring by the variations in the pressure of the gas contained in said chamber.

5. The device of claim 3 characterized in that said means for moving said slidable member comprise a variable volume and fluid-tight chamber, at least one spring member and a liquid contained in said chamber, said chamber being limited by a deformable and impermeable membrane connected to said slidable member, the volume variations of said chamber being caused, in opposition to said spring, by the variations in the pressure of the liquid contained in said chamber.

6. Casement windows, doors, and the like, having a sash and a device for locking and releasing the sash, said device comprising a stop-and-release member formed by a pair of pins that are slidable in a housing slot made in the framework of the said casement windows, doors and the like, said pins being rigidly connected to each other by means of a beam, resilient means being disposed symmetrically with respect to said pair of pins for maintaining the said pins out of the said housing slots, and a chamber of variable volume provided with a wall in the form of a flexible and extensible membrane disposed symmetrically with respect to the said pins, the edges of the said membrane being rigidly connected to the said pins.

7. A closure member for an opening comprising two side by side sashes each hinged along one edge to a frame about the opening and having opposite facing edges, said closure member comprising a cavity in the frame providing a chamber, spaced walls in the cavity providing partial partitions in the cavity forming slots, a pin disposed slidably in each slot, a base member attached to one end of each pin, a spring about each pin compressed between the base member and a closed end of the slot biasing each base member towards one of the sashes, a stop-pin carried by each base member projecting from the cavity to be disposed against the sash when the base member is biased by the spring and to be disposed away from the sash when the biasing action of the spring is overcome, and means for moving the base members away from the sash comprising a diaphragam associated with said base members and means for introducing air under pressure against the diaphragam and to expand it against the base members.

8. The device of claim 1 associated with a hinged closure member in position to lock the closure member in a closed position.

9. The device of claim 8 wherein the said hinged closure member is a casement window.

10. The device of claim 8 wherein the said hinged closure member is a door.

* * * * *